US009884411B2

(12) United States Patent
Hsu

(10) Patent No.: US 9,884,411 B2
(45) Date of Patent: Feb. 6, 2018

(54) TOOL STRUCTURE

(71) Applicant: Huang-Tung Hsu, Taichung (TW)

(72) Inventor: Huang-Tung Hsu, Taichung (TW)

( * ) Notice: Subject to any disclaimer, the term of this patent is extended or adjusted under 35 U.S.C. 154(b) by 274 days.

(21) Appl. No.: 14/948,472

(22) Filed: Nov. 23, 2015

(65) Prior Publication Data

US 2017/0144279 A1 May 25, 2017

(51) Int. Cl.
*B25B 23/00* (2006.01)

(52) U.S. Cl.
CPC ..... *B25B 23/0028* (2013.01); *B25B 23/0035* (2013.01)

(58) Field of Classification Search
CPC . B25B 23/0028; B25B 23/0035; B25B 15/02; B25B 15/04; B25B 23/16; B25G 1/00
See application file for complete search history.

(56) References Cited

U.S. PATENT DOCUMENTS 4,512,693 A * 4/1985 Swanson ..... B23B 51/00 279/14
4,848,197 A * 7/1989 Kikel ..... B25B 15/02 81/177.5
8,430,003 B1 * 4/2013 Johnson ..... B23Q 13/00 81/427.5
2010/0307297 A1 * 12/2010 Chiang ..... B25B 13/466 81/63.1

* cited by examiner

*Primary Examiner* — Robert Scruggs
(74) *Attorney, Agent, or Firm* — Alan D. Kamrath; Kamrath IP Lawfirm, P.A.

(57) ABSTRACT

A tool structure includes a base, a first retaining member, a connecting rod, a second retaining member, and a threaded rod. The first retaining member is received in the base. The second retaining member is received in the connecting rod and engages the first retaining member so that the connecting rod is limited in the slot of the base. Thus, the connecting rod is rotated relative to the base to adjust different angles between the connecting rod and the base. In addition, the connecting rod has a first mounting hole and a second mounting hole so that the connecting rod is available for two kinds of screwdriver tips with different sizes.

9 Claims, 15 Drawing Sheets

TOOL STRUCTURE

BACKGROUND OF THE INVENTION

1. Field of the Invention

The present invention relates to a tool structure and, more particularly, to a tool structure available for tool heads of different sizes.

2. Description of the Related Art

A conventional screwdriver tool comprises a shank having a first end provided with a tip, and a handle mounted on a second end of the shank. The tip has a flat shape, a cross shape or hexagonal shape. Thus, the user has to prepare multiple screwdriver tools with tips of different shapes, thereby increasing the cost of purchase, and thereby causing inconvenience in carrying and usage of the screwdriver tools. In addition, the angle between the shank and the handle cannot be adjusted to satisfy a special working place, so that the working place of the conventional screwdriver tool is limited.

BRIEF SUMMARY OF THE INVENTION

In accordance with the present invention, there is provided a tool structure comprising a base, a first retaining member mounted on the base, a connecting rod mounted on the base, a second retaining member mounted on the connecting rod, and a threaded rod extending through the first retaining member, the second retaining member, the connecting rod and the base. The base has an end provided with a driving portion. The base has a shank formed with a slot. The shank of the base has a first side formed with a screw bore and a second side formed with a first retaining hole and a through hole. The slot of the base is located between the screw bore and the through hole. The through hole of the base is located between the slot and the first retaining hole. The first retaining hole of the base has a polygonal shape. The first retaining member is received in the first retaining hole of the base and has a first fitting portion having a polygonal shape. The first fitting portion of the first retaining member has a side transversely formed with a first toothed section. The first toothed section of the first retaining member has a side formed with a first toothed face having multiple teeth. The first retaining member is formed with a first axle hole extending through the first fitting portion and the first toothed section. The connecting rod has a rod body which is pivotally mounted in the slot of the base. The rod body has a mediate portion transversely provided with a second retaining hole and an aperture connected to the second retaining hole. The second retaining hole has a polygonal shape. An elastic member is received in the second retaining hole of the connecting rod. The second retaining member is received in the second retaining hole of the connecting rod and is pushed by an end of the elastic member. The second retaining member has a second fitting portion having a polygonal shape. The second fitting portion of the second retaining member has a side transversely formed with a second toothed section. The second toothed section of the second retaining member has a side formed with a second toothed face having multiple teeth. The second retaining member is formed with a second axle hole extending through the second fitting portion and the second toothed section. The threaded rod extends through the first axle hole of the first retaining member, the second axle hole of the second retaining member and the aperture of the connecting rod, and is screwed into the screw bore of the base.

According to the primary advantage of the present invention, the connecting rod is rotated relative to the base to adjust the angle between the connecting rod and the base.

According to another advantage of the present invention, the first toothed face has multiple teeth, and the second toothed face has multiple teeth, so that the connecting rod is rotated to adjust different angles between the connecting rod and the base to facilitate the user operating the tool structure at different working places.

According to a further advantage of the present invention, the connecting rod has a first mounting hole and a second mounting hole so that the connecting rod is available for two kinds of screwdriver tips with different sizes.

According to a further advantage of the present invention, when the connecting rod is perpendicular to the base, the connecting rod is used as a T-shaped bar.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
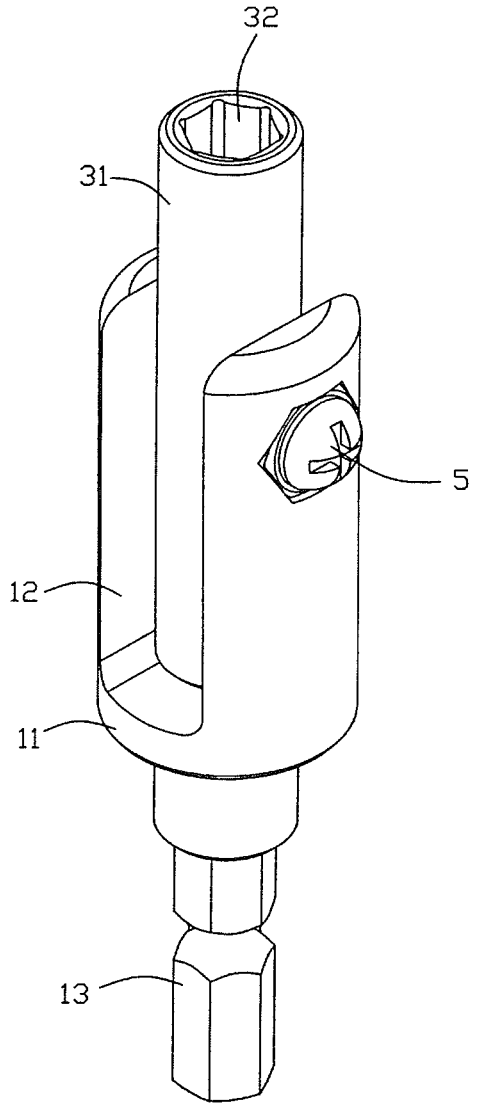
FIG. 1 is a perspective view of a tool structure in accordance with the preferred embodiment of the present invention.
Figures 2, 3:
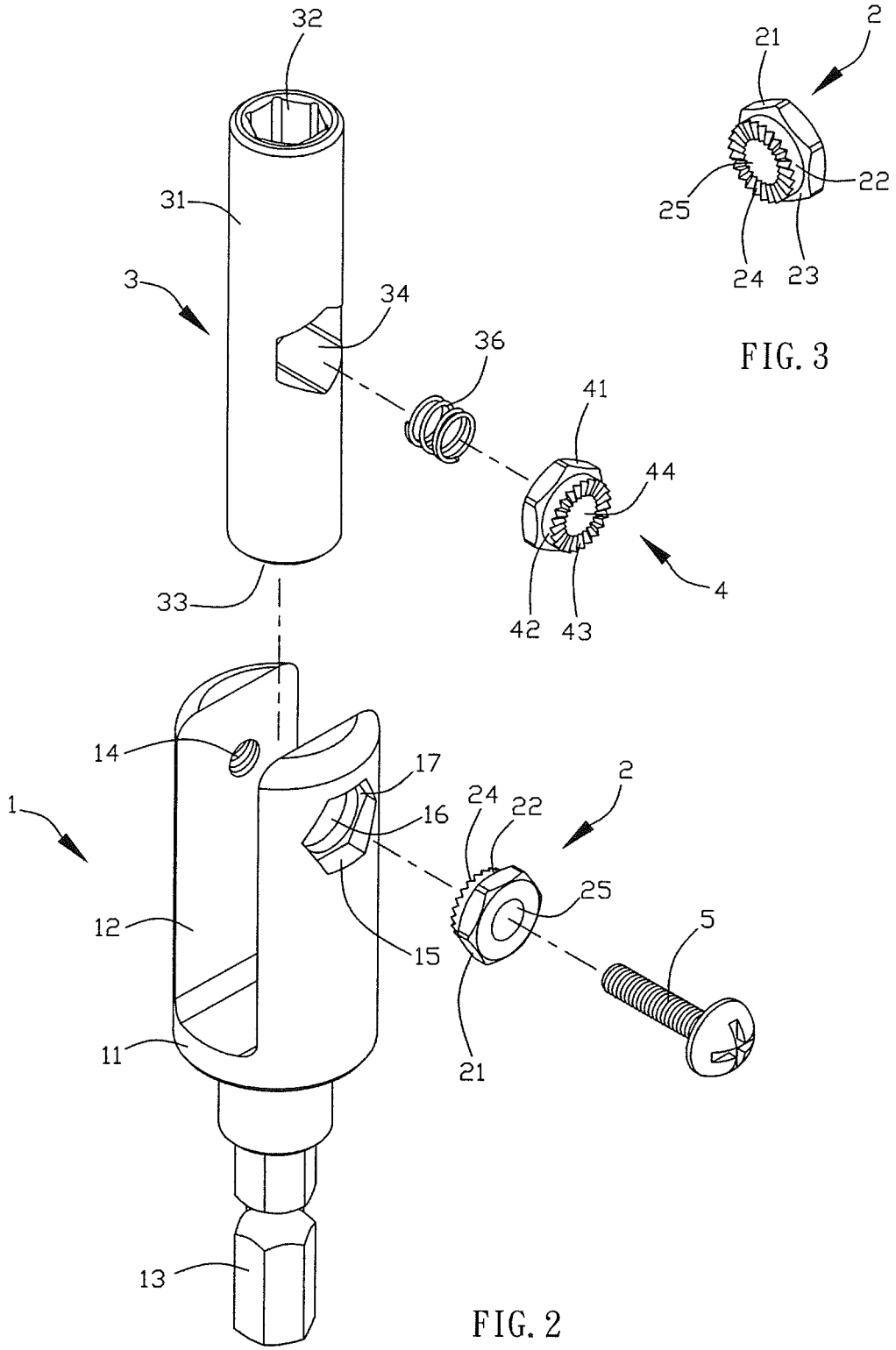
FIG. 2 is an exploded perspective view of the tool structure as shown in FIG. 1.
FIG. 3 is a perspective view of a first retaining member of the tool structure as shown in FIG. 2.
Figure 4:
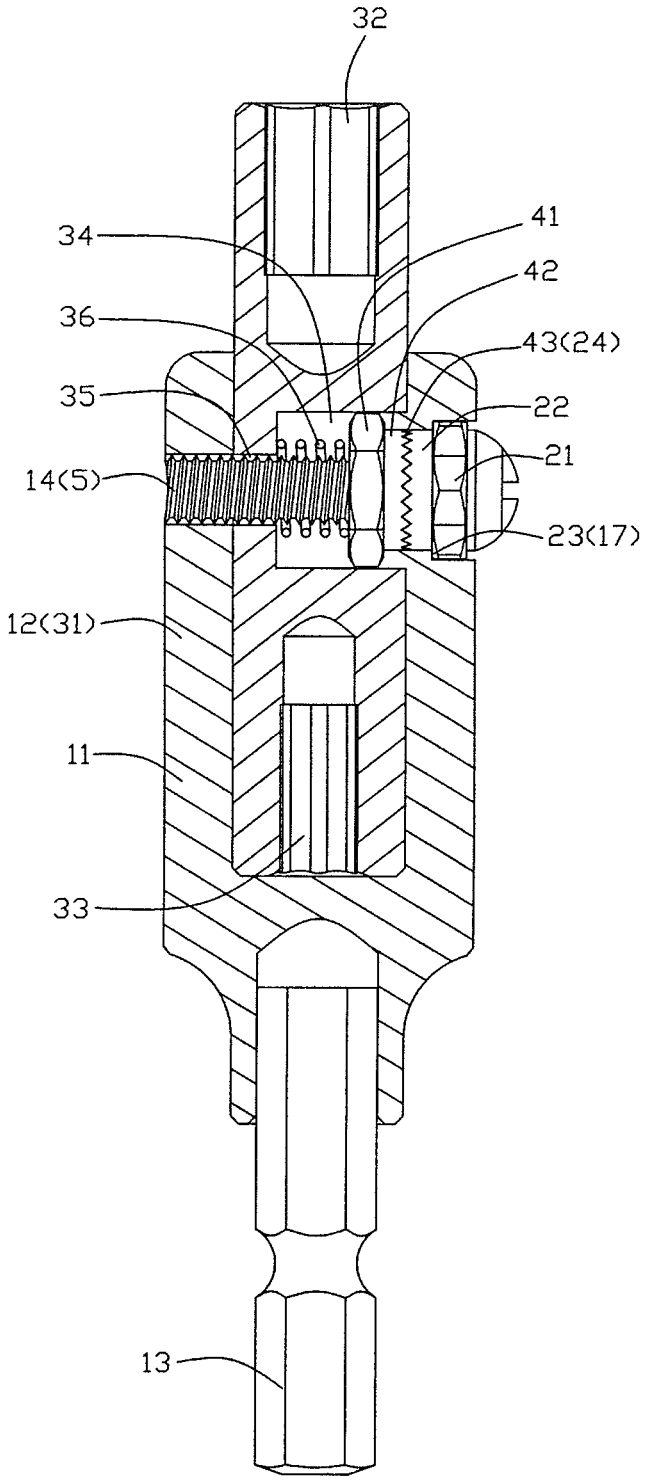
FIG. 4 is a cross-sectional view of the tool structure as shown in FIG. 1.
Figure 5:
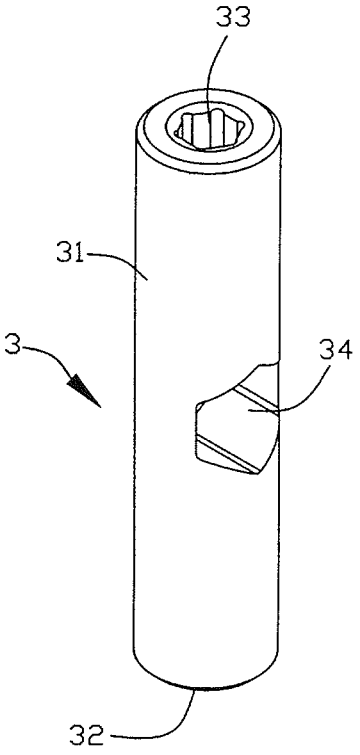
FIG. 5 is a perspective view of a connecting rod of the tool structure as shown in FIG. 2.
Figure 6:
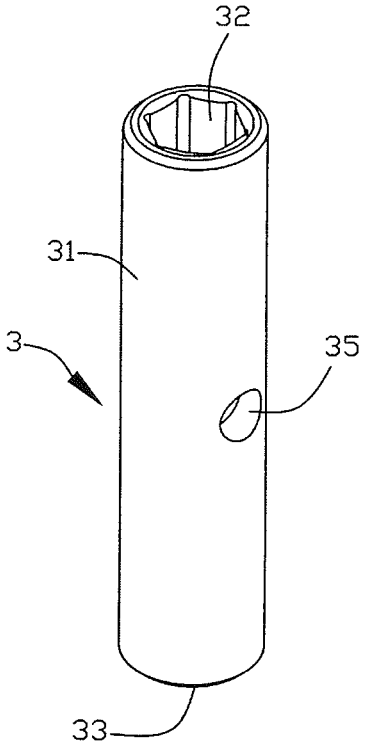
FIG. 6 is another perspective view of the connecting rod of the tool structure as shown in FIG. 2.
Figure 7:
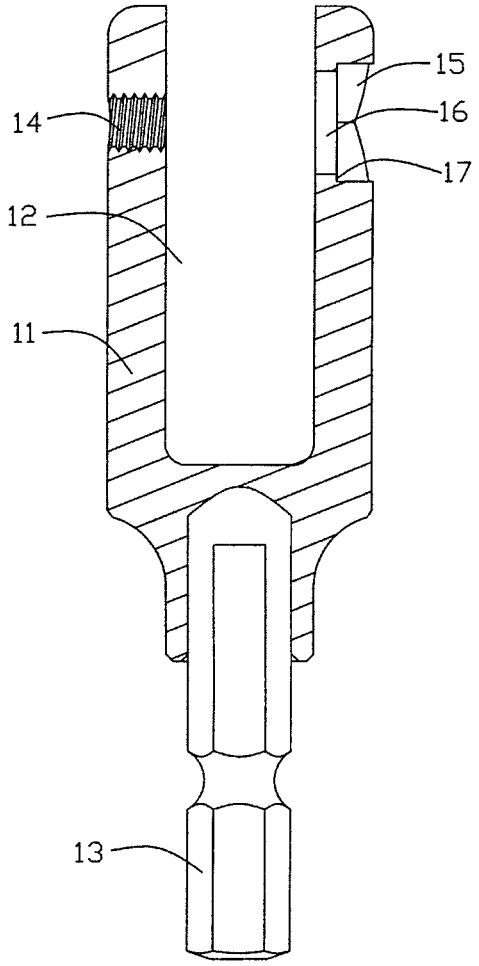
FIG. 7 is a cross-sectional view of a base of the tool structure as shown in FIG. 2.
Figure 8:
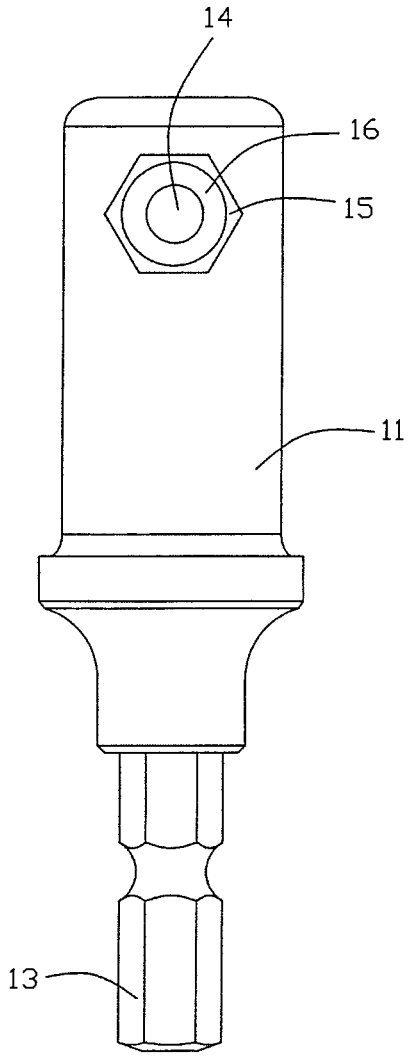
FIG. 8 is a side view of the base of the tool structure as shown in FIG. 2.

Referring to the drawings and initially to FIGS. 1-8, a tool structure in accordance with the preferred embodiment of the present invention comprises a base 1, a first retaining member 2 mounted on the base 1, a connecting rod 3 mounted on the base 1, a second retaining member 4 mounted on the connecting rod 3, and a threaded rod 5 extending through the first retaining member 2, the second retaining member 4, the connecting rod 3 and the base 1.

The base 1 has an end provided with a driving portion 13. The base 1 has a shank 11 formed with a slot 12. The shank 11 of the base 1 has a substantially U-shaped profile and has a first side formed with a screw bore 14 and a second side formed with a first retaining hole 15 and a through hole 16. The slot 12 of the base 1 is located between the screw bore 14 and the through hole 16. The through hole 16 of the base 1 is located between the slot 12 and the first retaining hole 15. The first retaining hole 15 of the base 1 has a polygonal shape.

The first retaining member 2 is received in the first retaining hole 15 of the base 1 and has a first fitting portion 21 having a polygonal shape. The first fitting portion 21 of the first retaining member 2 has a side transversely formed with a first toothed section 22 which is received in the through hole 16 of the base 1. The first toothed section 22 of the first retaining member 2 has a side formed with a first toothed face 24 having multiple teeth. The first retaining member 2 is formed with a first axle hole 25 extending through the first fitting portion 21 and the first toothed section 22.

The connecting rod 3 has a rod body 31 which is pivotally mounted in the slot 12 of the base 1. The rod body 31 of the connecting rod 3 has a first end provided with a first mounting hole 32 and a second end provided with a second mounting hole 33. The rod body 31 has a mediate portion transversely provided with a second retaining hole 34 and an aperture 35 connected to the second retaining hole 34. The second retaining hole 34 has a polygonal shape. An elastic member 36 is received in the second retaining hole 34 of the connecting rod 3. The elastic member 36 has a diameter greater than that of the aperture 35 of the connecting rod 3.

The second retaining member 4 is received in the second retaining hole 34 of the connecting rod 3 and is pushed by an end of the elastic member 36. The second retaining member 4 has a second fitting portion 41 having a polygonal shape. The second fitting portion 41 of the second retaining member 4 has a side transversely formed with a second toothed section 42. The second toothed section 42 of the second retaining member 4 has a side formed with a second toothed face 43 having multiple teeth. The second retaining member 4 is formed with a second axle hole 44 extending through the second fitting portion 41 and the second toothed section 42.

The threaded rod 5 extends through the first axle hole 25 of the first retaining member 2, the second axle hole 44 of the second retaining member 4 and the aperture 35 of the connecting rod 3, and is screwed into the screw bore 14 of the base 1.

In the preferred embodiment of the present invention, the through hole 16 of the base 1 has a dimension smaller than that of the first retaining hole 15, and the shank 11 of the base 1 is formed with a stop edge 17 located between the first retaining hole 15 and the through hole 16. The first fitting portion 21 of the first retaining member 2 is arranged in the first retaining hole 15 of the base 1 so that the first retaining member 2 is limited in the first retaining hole 15 of the base 1 and is non-rotatable relative to the base 1. The first toothed section 22 of the first retaining member 2 has a dimension smaller than that of the first fitting portion 21, and the first retaining member 2 is formed with a stepped face 23 located between the first fitting portion 21 and the first toothed section 22. The stepped face 23 of the first retaining member 2 abuts the stop edge 17 of the base. The rod body 31 of the connecting rod 3 has a circular or square shape. The first mounting hole 32 of the rod body 31 has a diameter different from that of the second mounting hole 33. The aperture 35 of the connecting rod 3 has a dimension smaller than that of the second retaining hole 34. The second fitting portion 41 of the second retaining member 4 is arranged in the second retaining hole 34 of the connecting rod 3 so that the second retaining member 4 is limited in the second retaining hole 34 of the connecting rod 3 and is non-rotatable relative to the connecting rod 3. The driving portion 13 of the base 1 has a hexagonal shape.

In assembly, the elastic member 36 is received in the second retaining hole 34 of the connecting rod 3. Then, the second fitting portion 41 of the second retaining member 4 is fitted into the second retaining hole 34 of the connecting rod 3, with the second toothed face 43 of the second retaining member 4 being directed outward from the second retaining hole 34 of the connecting rod 3. Then, the connecting rod 3 is fitted into the slot 12 of the base 1. Then, the first fitting portion 21 of the first retaining member 2 is arranged in the first retaining hole 15 of the base 1, and the first toothed section 22 of the first retaining member 2 is fitted into the through hole 16 of the base 1. Then, the threaded rod 5 in turn extends through the first axle hole 25 of the first retaining member 2, the second axle hole 44 of the second retaining member 4 and the aperture 35 of the connecting rod 3, and is screwed into the screw bore 14 of the base 1. In such a manner, the outer face of the first retaining member 2 is pressed by the threaded rod 5 so that the stepped face 23 of the first retaining member 2 abuts the stop edge 17 of the base. At this time, the second retaining member 4 is pushed by the elastic member 36 to move toward the first retaining member 2 until the second toothed face 43 of the second retaining member 4 engages the first toothed face 24 of the first retaining member 2, so that the connecting rod 3 is limited in the slot 12 of the base 1.

Figure 9:
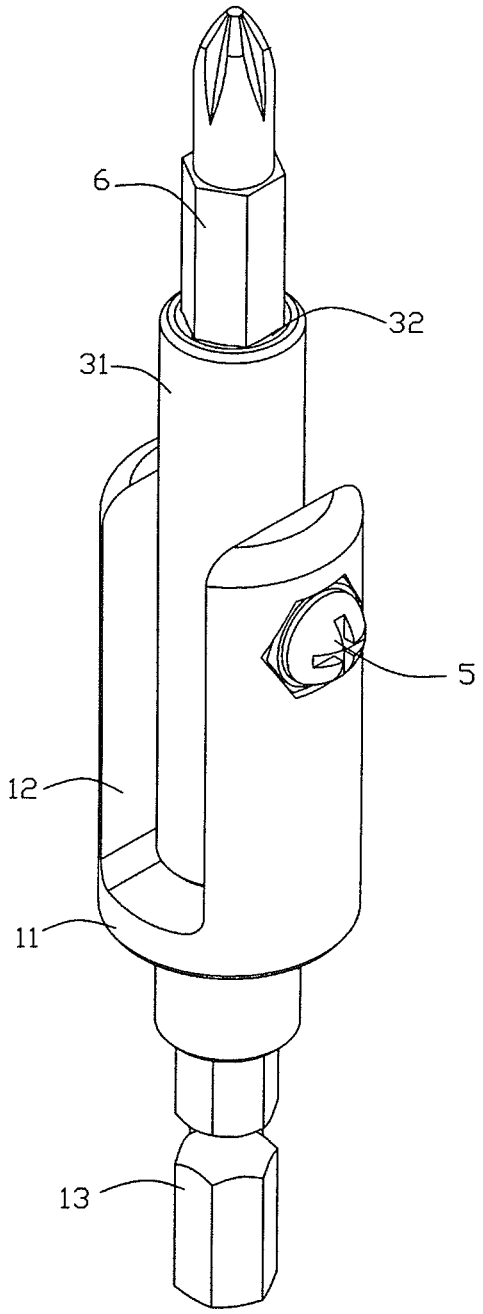
FIG. 9 is a schematic operational view of the tool structure as shown in FIG. 1 in use.
Figure 10:
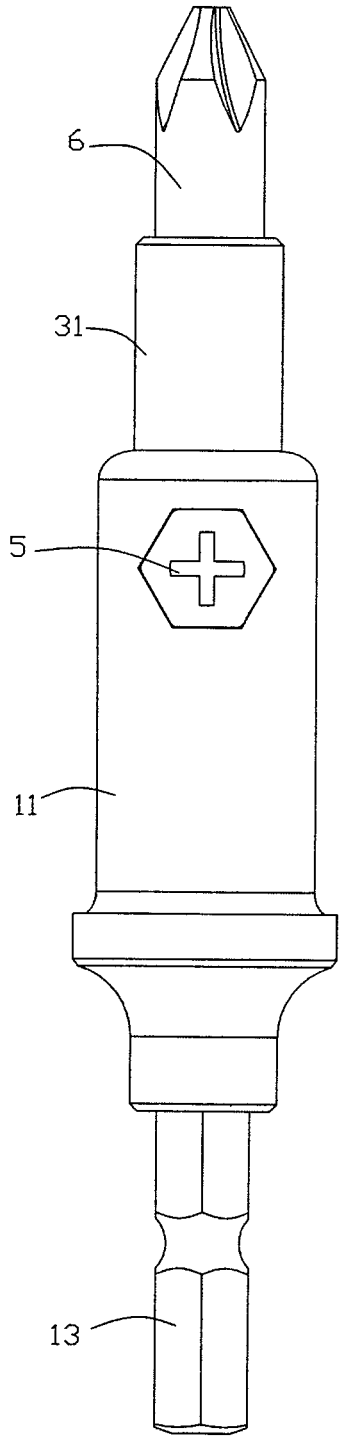
FIG. 10 is a side view of the tool structure as shown in FIG. 9.
Figure 11:
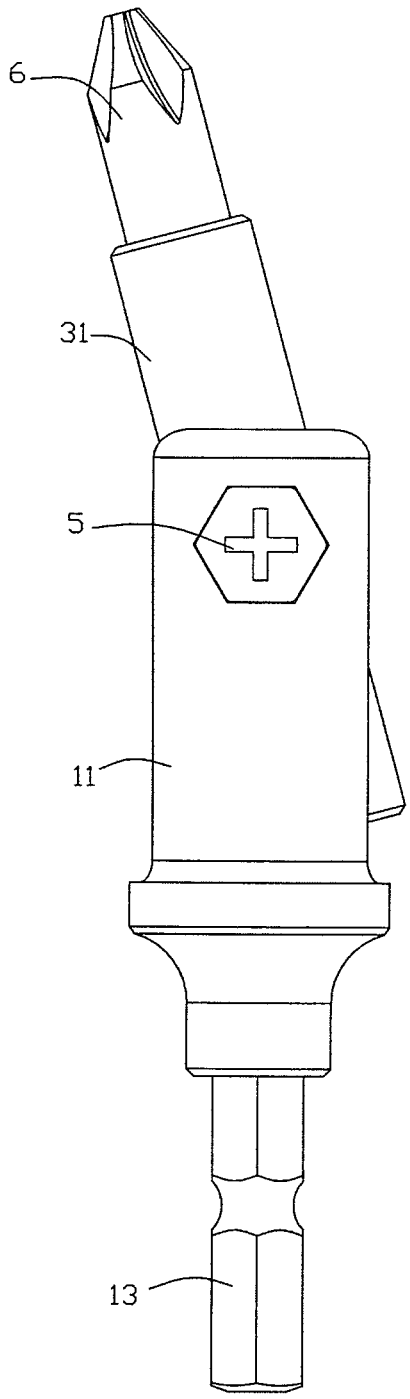
FIG. 11 is a schematic operational view of the tool structure as shown in FIG. 10.
Figure 12:
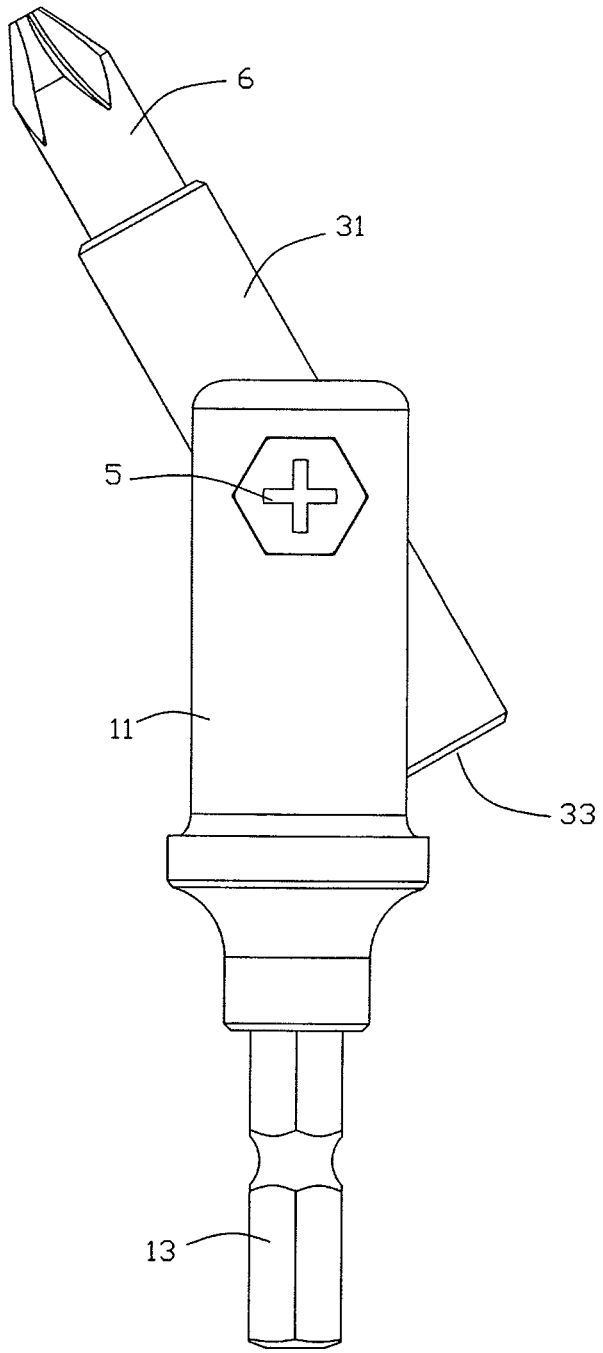
FIG. 12 is another schematic operational view of the tool structure as shown in FIG. 10.
Figure 13:
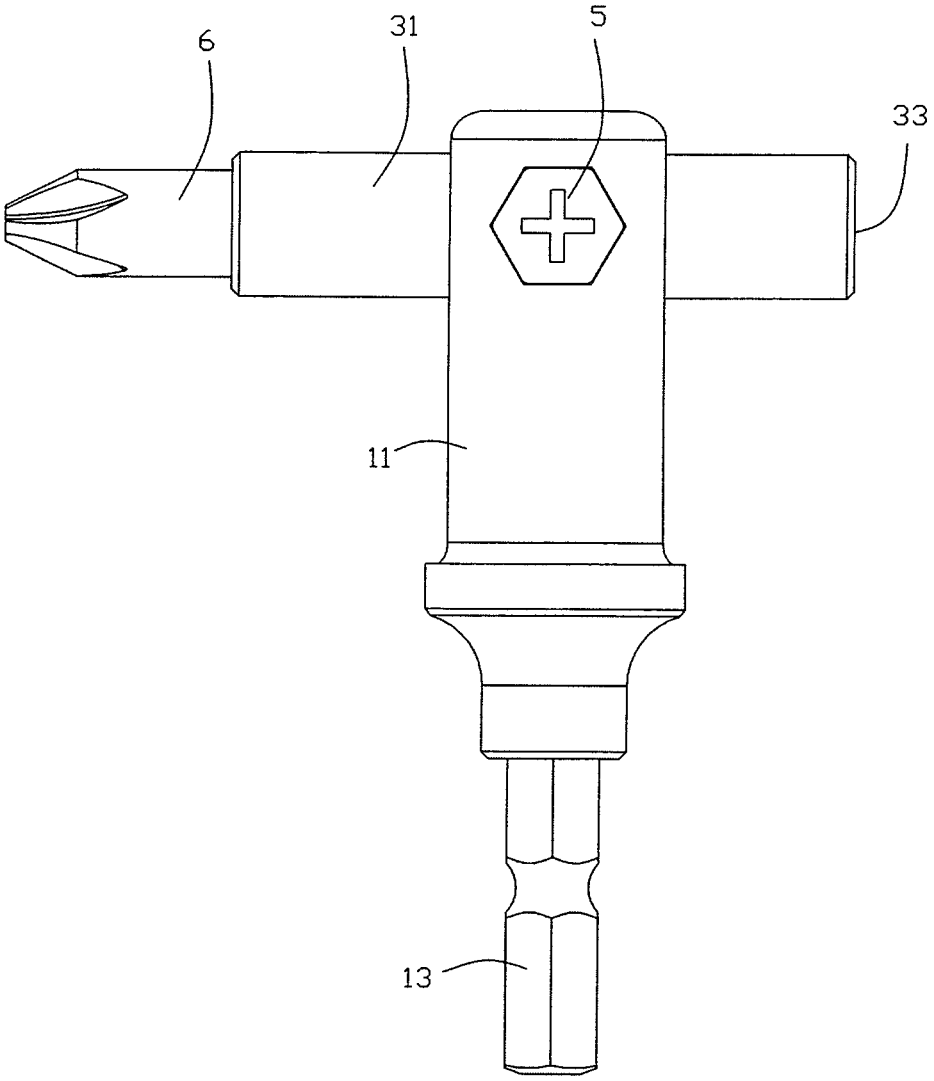
FIG. 13 is another schematic operational view of the tool structure as shown in FIG. 10.
Figure 14:
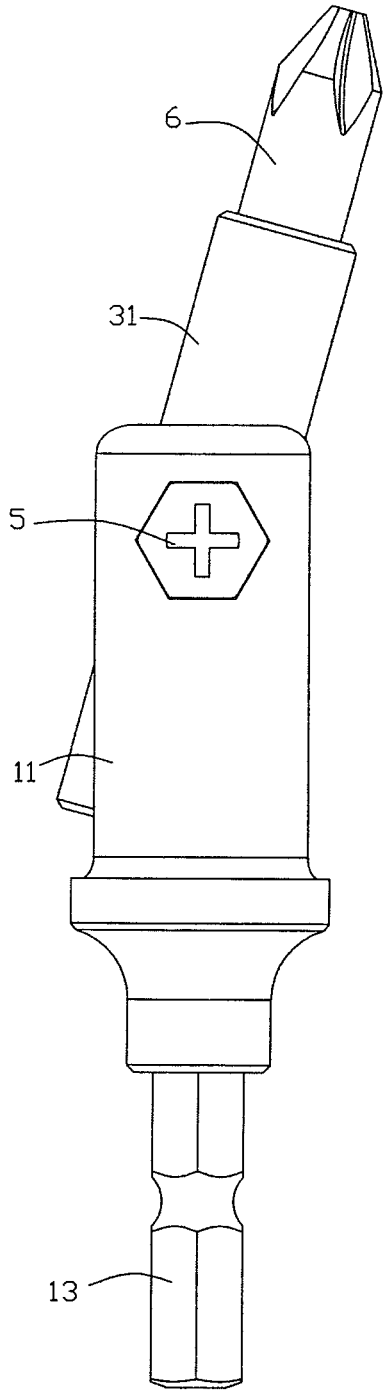
FIG. 14 is another schematic operational view of the tool structure as shown in FIG. 10.

Referring to FIGS. 9 and 10 with reference to FIGS. 1-8, a screwdriver tip 6 having a greater size is fitted into the first mounting hole 32 of the connecting rod 3, and a driving tool (not shown) is mounted on the driving portion 13 of the base 1. At this time, the second toothed face 43 of the second retaining member 4 engages the first toothed face 24 of the first retaining member 2, so that the connecting rod 3 is limited the slot 12 of the base 1. Thus, the screwdriver tip 6 can be driven by the driving tool.

Referring to FIGS. 11-14 with reference to FIGS. 1-8, when a user's hand exerts a force on the rod body 31 of the connecting rod 3 to overcome the elastic force of the elastic member 36, the second retaining member 4 is forced to retract into the second retaining hole 34 of the connecting rod 3, so that the connecting rod 3 is driven by the force to rotate about the threaded rod 5. At this time, the second fitting portion 41 of the second retaining member 4 is limited in the second retaining hole 34 of the connecting rod 3, so that the second retaining member 4 is also rotated with the rod body 31 of the connecting rod 3. When the user stops driving the rod body 31 of the connecting rod 3, the second retaining member 4 is pushed by the restoring force of the elastic member 36 to move toward the first retaining member 2 so that the second toothed face 43 of the second retaining member 4 again engages the first toothed face 24 of the first retaining member 2, and the connecting rod 3 is limited in the slot 12 of the base 1. Thus, the connecting rod 3 is rotated relative to the base 1 to adjust an angle between the connecting rod 3 and the base 1. At this time, the first toothed face 24 has multiple teeth, and the second toothed face 43 has multiple teeth, so that the connecting rod 3 is rotated to adjust different angles between the connecting rod 3 and the base 1 as shown in FIGS. 11-14.

Figure 15:
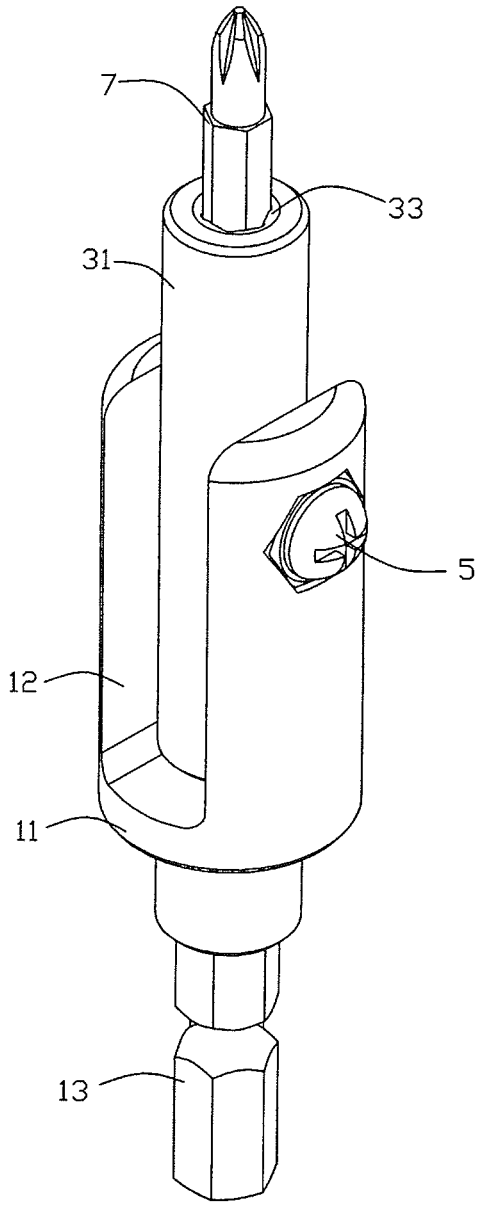
FIG. 15 is another schematic operational view of the tool structure as shown in FIG. 1 in use.
Figure 16:
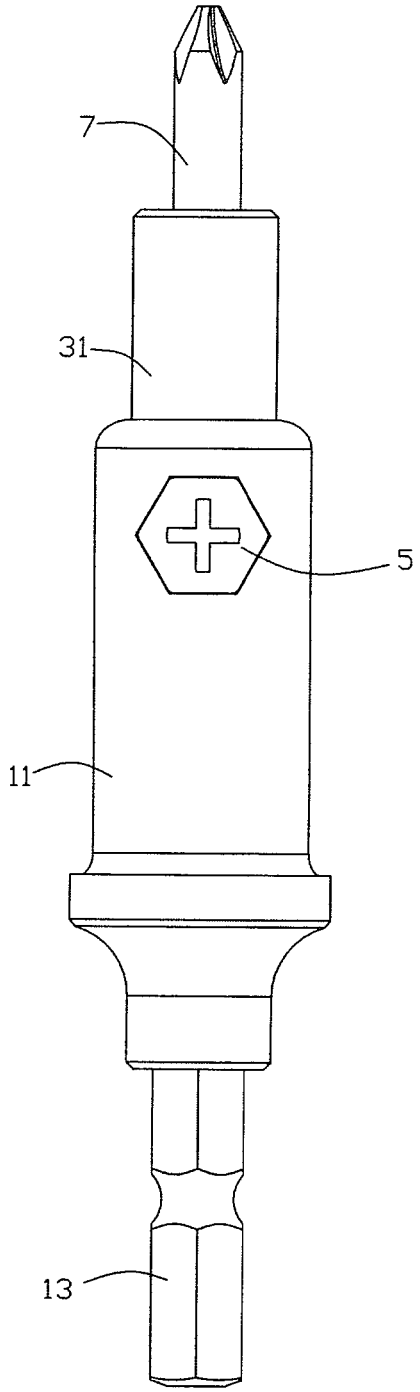
FIG. 16 is a side view of the tool structure as shown in FIG. 15.

Referring to FIGS. 15 and 16, the rod body 31 of the connecting rod 3 is driven to rotate relative to the base 1 until the second mounting hole 33 of the connecting rod 3 is directed upward. In such a manner, a screwdriver tip 7 having a smaller size is fitted into the second mounting hole 33 of the connecting rod 3, and a driving tool (not shown) is mounted on the driving portion 13 of the base 1. At this time, the second toothed face 43 of the second retaining member 4 engages the first toothed face 24 of the first retaining member 2, so that the connecting rod 3 is limited the slot 12 of the base 1. Thus, the screwdriver tip 7 can be driven by the driving tool.

Figure 17:
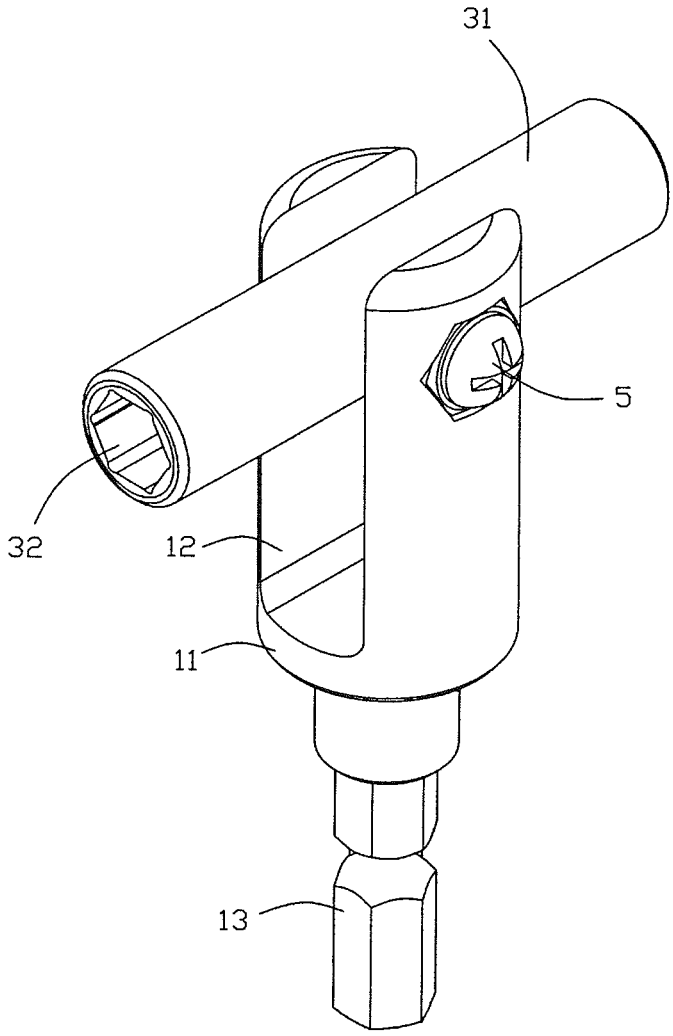
FIG. 17 is another schematic operational view of the tool structure as shown in FIG. 1 in use.

Referring to FIG. 17, the rod body 31 of the connecting rod 3 is driven to rotate relative to the base 1 until the rod body 31 of the connecting rod 3 is perpendicular to the base 1. Thus, the rod body 31 of the connecting rod 3 is used as a T-shaped bar, so that the driving portion 13 of the base 1 is used to adjust a hexagonal countersunk screw.

Figure 18:
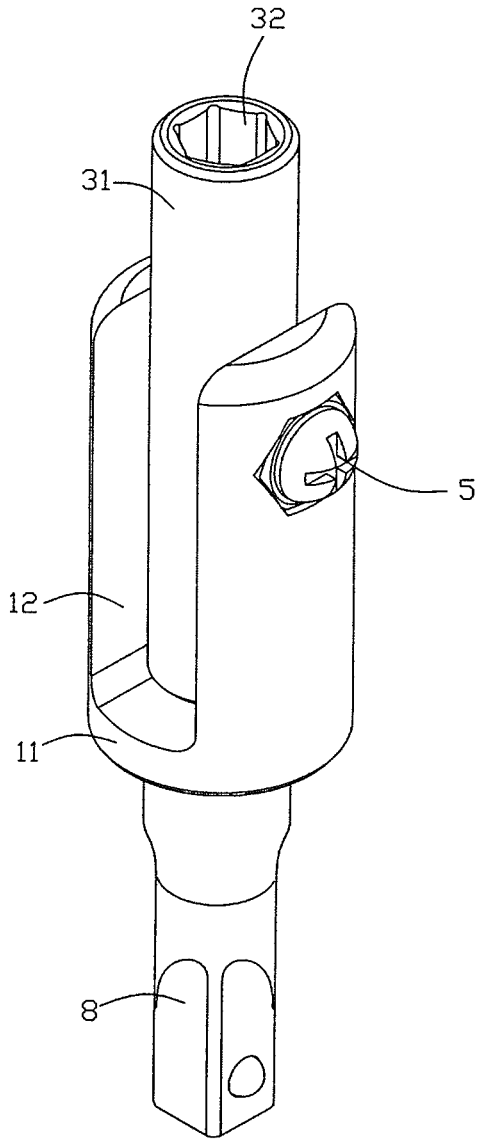
FIG. 18 is a perspective view of a tool structure in accordance with another preferred embodiment of the present invention.

Referring to FIG. 18, the driving portion 8 of the base 1 has a tetragonal shape.

Accordingly, the connecting rod 3 is rotated relative to the base 1 to adjust the angle between the connecting rod 3 and the base 1. In addition, the first toothed face 24 has multiple teeth, and the second toothed face 43 has multiple teeth, so that the connecting rod 3 is rotated to adjust different angles between the connecting rod 3 and the base 1 to facilitate the user operating the tool structure at different working places. Further, the connecting rod 3 has a first mounting hole 32 and a second mounting hole 33 so that the connecting rod 3 is available for two kinds of screwdriver tips with different sizes. Further, when the connecting rod 3 is perpendicular to the base 1, the connecting rod 3 is used as a T-shaped bar.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A tool structure comprising:

a base;

a first retaining member mounted on the base;

a connecting rod mounted on the base;

a second retaining member mounted on the connecting rod; and a threaded rod extending through the first retaining member, the second retaining member, the connecting rod and the base;

wherein:

the base has an end provided with a driving portion;

the base has a shank formed with a slot;

the shank of the base has a first side formed with a screw bore and a second side formed with a first retaining hole and a through hole;

the slot of the base is located between the screw bore and the through hole;

the through hole of the base is located between the slot and the first retaining hole;

the first retaining hole of the base has a polygonal shape;

the first retaining member is received in the first retaining hole of the base and has a first fitting portion having a polygonal shape;

the first fitting portion of the first retaining member has a side transversely formed with a first toothed section;

the first toothed section of the first retaining member has a side formed with a first toothed face having multiple teeth;

the first retaining member is formed with a first axle hole extending through the first fitting portion and the first toothed section;

the connecting rod has a rod body which is pivotally mounted in the slot of the base;

the rod body has a mediate portion transversely provided with a second retaining hole and an aperture connected to the second retaining hole;

the second retaining hole has a polygonal shape;

an elastic member is received in the second retaining hole of the connecting rod;

the second retaining member is received in the second retaining hole of the connecting rod and is pushed by an end of the elastic member;

the second retaining member has a second fitting portion having a polygonal shape;

the second fitting portion of the second retaining member has a side transversely formed with a second toothed section;

the second toothed section of the second retaining member has a side formed with a second toothed face having multiple teeth;

the second retaining member is formed with a second axle hole extending through the second fitting portion and the second toothed section; and the threaded rod extends through the first axle hole of the first retaining member, the second axle hole of the second retaining member and the aperture of the connecting rod, and is screwed into the screw bore of the base.

2. The tool structure of claim 1, wherein the through hole of the base has a dimension smaller than that of the first retaining hole, and the shank of the base is formed with a stop edge located between the first retaining hole and the through hole.

3. The tool structure of claim 1, wherein the first fitting portion of the first retaining member is arranged in the first retaining hole of the base so that the first retaining member is limited in the first retaining hole of the base and is non-rotatable relative to the base.

4. The tool structure of claim 1, wherein the first toothed section of the first retaining member has a dimension smaller than that of the first fitting portion, and the first retaining member is formed with a stepped face located between the first fitting portion and the first toothed section.

5. The tool structure of claim 1, wherein the rod body of the connecting rod has a circular or square shape.

6. The tool structure of claim 1, wherein the rod body of the connecting rod has a first end provided with a first mounting hole and a second end provided with a second mounting hole, and the first mounting hole of the rod body has a diameter different from that of the second mounting hole.

7. The tool structure of claim 1, wherein the aperture of the connecting rod has a dimension smaller than that of the second retaining hole.

8. The tool structure of claim 1, wherein the second fitting portion of the second retaining member is arranged in the second retaining hole of the connecting rod so that the second retaining member is limited in the second retaining hole of the connecting rod and is non-rotatable relative to the connecting rod.

9. The tool structure of claim 1, wherein the driving portion of the base has a hexagonal or tetragonal shape.

* * * * *